US006123626A

United States Patent [19]

Osborn

[11] Patent Number: 6,123,626

[45] Date of Patent: Sep. 26, 2000

[54] LASER PUTTER SYSTEM

[76] Inventor: Brian S. Osborn, 215 S. Houghton, Milford, Mich. 48381

[21] Appl. No.: 09/283,806

[22] Filed: Apr. 1, 1999

[51] Int. Cl.[7] ..... A63B 57/00; A63B 69/36

[52] U.S. Cl. ..... 473/220; 473/219; 473/220; 473/221; 473/222; 473/223; 473/226; 473/227; 473/231; 104/53; 104/62; 104/106

[58] Field of Search ..... 473/220, 219, 473/223, 226, 227, 221, 222, 231; 104/53, 62, 106

[56] References Cited

U.S. PATENT DOCUMENTS

| | | | |
|---|---|---|---|
| 2,776,836 | 1/1957 | Zadina | 60/467 |
| 3,493,925 | 2/1970 | Brancale | 340/932.2 |
| 4,297,701 | 10/1981 | Henriques | 342/42 |
| 4,601,472 | 7/1986 | O'Flanagan | 473/240 |
| 5,046,839 | 9/1991 | Krangle | 473/220 |
| 5,207,429 | 5/1993 | Walmsley et al. | 473/220 |
| 5,213,331 | 5/1993 | Avanzini | 473/220 |
| 5,245,537 | 9/1993 | Barber | 473/407 |
| 5,275,398 | 1/1994 | Compton | 473/2 |
| 5,374,063 | 12/1994 | Ogden | 473/220 |
| 5,388,831 | 2/1995 | Quadri et al. | 473/220 |
| 5,388,832 | 2/1995 | Hsu | 473/220 |
| 5,435,562 | 7/1995 | Stock et al. | 473/409 |
| 5,438,518 | 8/1995 | Bianco et al. | 364/460 |
| 5,452,897 | 9/1995 | Mick | 473/220 |
| 5,465,972 | 11/1995 | Cornett | 473/220 |
| 5,468,199 | 11/1995 | Keeler et al. | 482/35 |
| 5,472,204 | 12/1995 | English et al. | 473/220 |
| 5,482,283 | 1/1996 | Wall | 473/220 |
| 5,492,329 | 2/1996 | Kronin | 473/220 |
| 5,494,290 | 2/1996 | Stefanoski | 473/220 |
| 5,527,041 | 6/1996 | Terry, III et al. | 473/150 |
| 5,532,677 | 7/1996 | Miller | 340/286.01 |
| 5,562,285 | 10/1996 | Anfinsen et al. | 473/155 |
| 5,593,354 | 1/1997 | Falossi et al. | 473/220 |
| 5,692,965 | 12/1997 | Nighan, Jr. et al. | 473/220 |
| 5,707,296 | 1/1998 | Hodgson et al. | 473/220 |
| 5,707,297 | 1/1998 | Shu | 473/220 |
| 5,964,668 | 10/1999 | Tai et al. | 473/220 |

*Primary Examiner*—Lee Young
*Assistant Examiner*—Paul Kim
*Attorney, Agent, or Firm*—Joseph N. Breaux

[57] ABSTRACT

A laser putter system for a conventional putter golf club of the type having a club head with a golf ball striking face and an upper surface, a shaft connected to the upper surface of the club head and a grip on the shaft. The laser putter system comprises a laser pointer/range finder. A mounting means is for mounting the laser pointer/range finder onto the shaft of the conventional putter golf club over the upper surface of the club head. The laser pointer can project a laser beam away from the golf ball striking face of the club head to provide the golfer with a visible target being a hole to putt a golf ball into. The range finder will interpret the distance between the laser pointer and the hole to visually give the golfer a calculated distance to the hole, so as to gauge the proper force required for a successful putt.

3 Claims, 4 Drawing Sheets

LASER PUTTER SYSTEM

TECHNICAL FIELD

The present invention relates to aiming mechanisms for aiming a golf putter face at a desired target and more particularly to a laser putter system. A conventional golf putter is provided for putting a golf ball on a golf green into a hole. The laser putter system includes a laser pointer/range finder attached to the shaft of the conventional golf putter in an adjustable manner. The laser pointer/range finder is oriented so that a ninety degree angle is achieved with respect to the striking head of the club head. The golfer aims a laser beam from the laser pointer/range finder at the hole. A readout on an light emitting diode display will visually indicate the height in which the golf ball must be raised in order to reach the hole.

BACKGROUND ART

Numerous aiming mechanisms for aiming a golf putter face at a desired target have been provided in prior art. For example, U.S. Pat. No. 5,207,429 to Walmsley et al.; U.S. Pat. No. 5,374,063 to Ogden; U.S. Pat. No. 5,388,831 to Quadri et al.; U.S. Pat. No. 5,435,562 to Stock et al.; U.S. Pat. No. 5,452,897 to Mick; U.S. Pat. No. 5,465,972 to Cornett; U.S. Pat. No. 5,482,283 to Wall; U.S. Pat. No. 5,492,329 to Kronin; U.S. Pat. No. 5,494,290 to Stefanoski; U.S. Pat. No. 5,692,965 to Nighan, Jr. et al.; U.S. Pat. No. 5,707,296 to Hodgson et al. And U.S. Pat. No. 5,707,297 to Shu all are illustrative of such prior art. While these units may be suitable for the particular purpose to which they address, they would not be as suitable for the purposes of the present invention as heretofore described.

The Walmsley et al. U.S. Pat. No. 5,207,429 discloses a club aiming unit. A club aiming unit for attachment to a club providing a moans for enabling the orientation of the impact surface of a club head with respect to the target to be monitored during the swinging of a club. In particular, the invention is particularly useful in relation to croquet mallets or golf putters. The club aiming unit comprises a first light source producing a first planar beam of light having a narrow and substantially linear cross-section that projects a line of light onto a surface, and attachment means for mounting the first light source to the club such that the first beam is projected over the preferred impact point of the impact surface with the plane of the first beam perpendicular to the impact surface, causing a line of light to be projected onto any surface immediately below the club head. The projected line of light provides a reference mark which can be viewed during the swinging of the club, such that a person may concentrate their attention on the object being hit, while at the same time being able to see the movement of the projected line, thereby enabling the impact face of the club head to be maintained square to the target line. This provides a novel training means which enables a useful means of controlling the orientation of a club head during the swinging of the club.

The Ogden U.S. Pat. No. 5,374,063 discloses a golf apparatus. A golf apparatus is provided for practicing aligning the head of a golf club with a golf ball to be struck by the club head prior to swinging the club. The golf apparatus has a light source on the club head for directing a beam of light toward a golf ball and a receiver on the club head for receiving light reflected by the golf ball. The tight source and the receiver are positioned such that reflected light reaches the receiver when the golf club head and the golf ball are in a predefined relative position. In the predefined relative position of the club head and a golf ball, a line connecting the center of a golf ball and a point of preferred contact on the club face is perpendicular to the club face. An indicator light on the club head provides a visible indication that the club head and a golf ball are in the predefined relative position.

The Quadri et al. U.S. Pat. No. 5,388,831 discloses a luminous golf practice device. A device designed to be fitted to or built into a golf club such as a putter to assist in learning the correct club position, in particular for indoor or home putting practice. A transmitter unit is releasably attached to the shaft of the club and comprises a laser diode for transmitting a parallel light beam towards an optical unit having a cylindrical lens above the club iron. The lens diffuses the light along a vertical plane to form a beam directed at the ground in front of the iron, whereby the player is able to see a line of light on the ball and on the ground indicating the direction in which the ball will travel depending on the position of the striking surface of the iron. In one embodiment, the optical system may be supported by an arm attached to the shaft.

The Stock et al. U.S. Pat. No. 5,435,562 discloses a golf club laser alignment device. A golf club having a laser generating diode and a laser reflecting prism mounted in the hosel for emitting a laser beam perpendicular to the shaft of the club. The laser generating diode is energized by a battery in the grip of the club, through a switch on the grip. The laser beam emitted from the hosel demonstrates the direction in which the club face is aligned.

The Mick U.S. Pat. No. 5,452,897 discloses a laser aided putter alignment system. A method and an apparatus for determining an individual's inaccurate aim in hitting a golf ball. A mirrored surface is disposed at a ball striking surface of a golf club and a golf ball on a location on a generally horizontal surface. The individual, while assuming a normal golf ball hitting stance on the generally horizontal surface, addresses the golf ball with the golf club and aligns the golf club adjacent to the golf ball in a direction believed to be the correct direction of a target. The golf ball is removed and a beam is directed to the mirrored surface. The deviation between a line normal to the mirrored surface and a line between the location and the target is measured, using the beam, as it is reflected from the mirrored surface, to determine the amount of the deviation.

The Cornett U.S. Pat. No. 5,465,972 discloses a golf putting aid. A laser sighting unit is attached to a putter or a wedge. The laser sighting unit includes a clamp which attaches an adjustable bracket and a laser unit to the shaft of a golf club. The laser unit is activated by a switch that is removably attached to the handle of the golf club. The laser sighting unit can be attached or removed from a golf club without any alterations to the golf club, and without the aid of tools. The laser sighting unit is used to aid a golfer in obtaining proper alignment of the golf club before the golf ball is hit.

The Wall U.S. Pat. No. 5,482,283 discloses a golf club. A golf club having a shaft, a head secured to one end of the shaft and a grip handle secured to the other end of the shaft. A light generator and an energy source positioned in operative connection to generate a plurality of light beams emanating from the club head hitting surface on opposite sides of a centrally located sweet spot, respectively. The light beams converging toward and intersecting an imaginary line extending from the sweet spot generally perpendicularly to the surface and through the center of the golf ball to be hit by the club.

The Kronin U.S. Pat. No. 5,492,329 discloses a golf putter with electronic leveling device and message display. A putter including an electronic leveling device contains a source of electrical energy. A display means for producing a signal composed of a plurality of light emitting diodes when the circuit is energized. A light diffusion means placed over the signal for displaying messages and the like for promotional and advertising purposes. An electric circuit means for electrically joining the display means to the source of electrical energy. A switch means in the electric circuit means and movable between a closed position where electrical energy is permitted to pass from the source of electrical energy to the display means through the aforementioned electric circuit means to electrically energize the display means producing a signal composed of a plurality of LEDs and illuminating the light diffusing means that lights a message or the like on the surface of the light diffusing means. The switch means being in the closed position when the longitudinal axis of the putter head is held at an angle that is unparallel to the horizon and an open position in which electrical energy is prevented from passing from the source of electrical energy to the display means through the electrical circuit means when the longitudinal axis of the putter head is held parallel to the horizon.

The Stefanoski U.S. Pat. No. 5,494,290 discloses a laser putter. A laser putter comprised of a golf putter having a putting head, a shaft portion, and a hollow handle portion. A laser is secured to the hollow handle portion. A convex mirror is secured to the hollow handle portion downwardly of the laser secured thereto. A laser light beam is reflected from the convex mirror onto the ground forwardly of the putter head along a line perpendicular to the putting face to provide a line of sight which aids in lining up a putt. In a second embodiment, the light beam is reflected from a first flat mirror to a second flat mirror and then to the convex mirror.

The Nigham, Jr., et al. U.S. Pat. No. 5,692,965 discloses a golf swing training device with laser. A golf swing training device includes a golf club including a head coupled to a shaft. At least one laser device detachably coupled to the shaft of the golf club and produces at least one laser beam. A power source is coupled to the laser device. An attachment mechanism detachably secures the laser device to the golf club shaft in a manner such that the laser beam provides a feedback signal to the golfer that is indicative of a position and a motion of the head during the top of a backswing of the golf club by the golfer.

The Hodgson et al. U.S. Pat. No. 5,707,296 discloses a training putter with laser line alignment system. A putter including a club head, a shaft, a handle, a ball striking face, a heel, a toe, and an upper surface, with the shaft being connected to the upper surface. A pair of light sources located in the ball striking face. One light source is located adjacent to the heel and other light source is located adjacent the toe. Also, included in the putter is a power source for energizing the light sources. A switch for connecting the light sources to the power source. An optical device associated with each of the light sources for focusing a light beam from the light sources, when the light sources are energized, into a continuous, visible linear image of light in the form of a persistent, visual pair of alignment lines on a putting surface. The pair of alignment lines extend forwardly of and perpendicular to the striking face from a point on the putting surface adjacent the ball striking face towards a remote target, the image being formed at each side of a golf ball when the putter head is in place behind the ball prior to and during the execution of a putting stroke.

The Shu U.S. Pat. No. 5,707,297 discloses a practice device for golfers. Disclosed is a laser aiming device removably mounted on a putter mainly including a sidewardly opened clamping member and a laser emitter. The clamping member firmly clamps on a rear edge of a head portion of the putter with screws threading from a top surface of the clamping member downward toward the rear edge of the putter. A receiving seat is also provided on the top surface of the clamping member to receive a housing of the laser emitter. The laser emitter further includes a number of batteries and a laser producing means accommodated in the housing. The laser emitter is electrically connected to a pressure switch provided at a bottom surface of the clamping member when it is put into the receiving seat. When a putter mounted with the laser aiming device is used to practice putting, the user may gently press the putter against the ground to turn on the pressure switch and therefore causes the laser producing means to emit a laser beam which emits out of the housing above the head portion of the putter and can be aimed at a target of putting. The laser emitter can be conveniently removed from the putter so that the same putter can be immediately used in a game.

GENERAL SUMMARY DISCUSSION OF INVENTION

The laser putter system consists of a laser pointer/range finder placed inside a circular housing with a bottom mounted on/off switch. The circular housing is mounted to an arm secured into a longitudinal track of a rail. Both edges of the rail contains a series of hash marks measured in quarter-inch and inch increments. The rail includes rail clamps with thumbscrew adjustments allowing it to be mounted to a variety of putter shafts. Leading from the laser pointer/range finder is a cable for a light emitting diode display attached to a clamp with a thumbscrew adjustment, similar to the clamps used to mount the rail. All of the clamps are used to hold the cable in place during use. Power to the laser putter system is provided by a set of disposable button-style batteries.

A primary object of the present invention is to provide a laser putter system that will overcome the shortcomings of the prior art devices.

Another object is to provide a laser putter system that is a laser pointer/range finder combination designed to be mounted upon an existing golf putter.

An additional object is to provide a laser putter system which will combine onto an existing golf putter a laser pointer to aid a golfer's aim and a range finder to aid a golfer in gauging the golfer's putting strength, to enable golfers to improve their golf score.

A further object is to provide a laser putter system that is simple and easy to use.

A still further object is to provide a laser putter system that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

Similar reference characters denote corresponding features consistently throughout the attached drawings.

EXEMPLARY MODE FOR CARRYING OUT THE INVENTION

Figure 1:
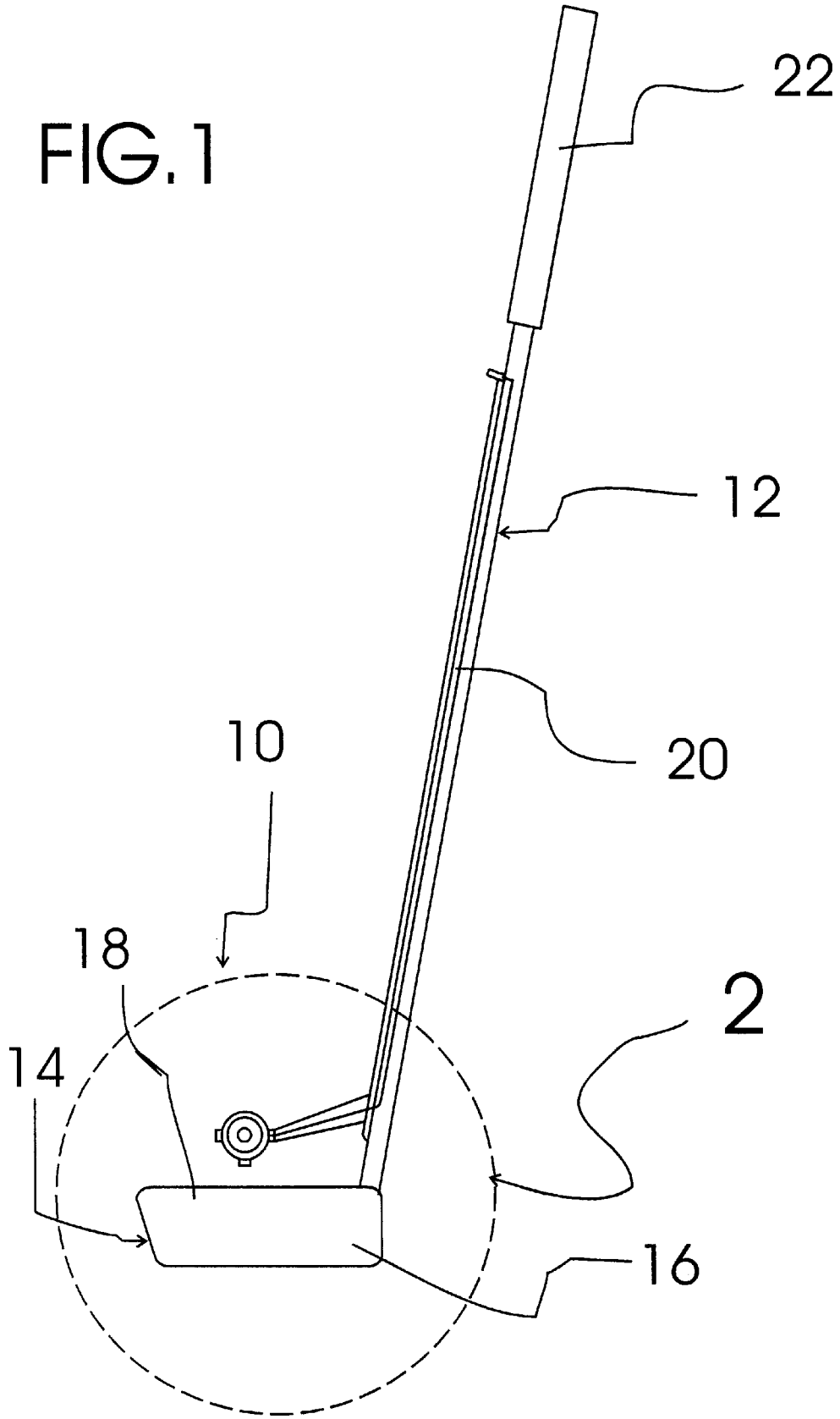
FIG. 1 is a front view of the present invention mounted upon a standard golf putter club.
Figure 2:
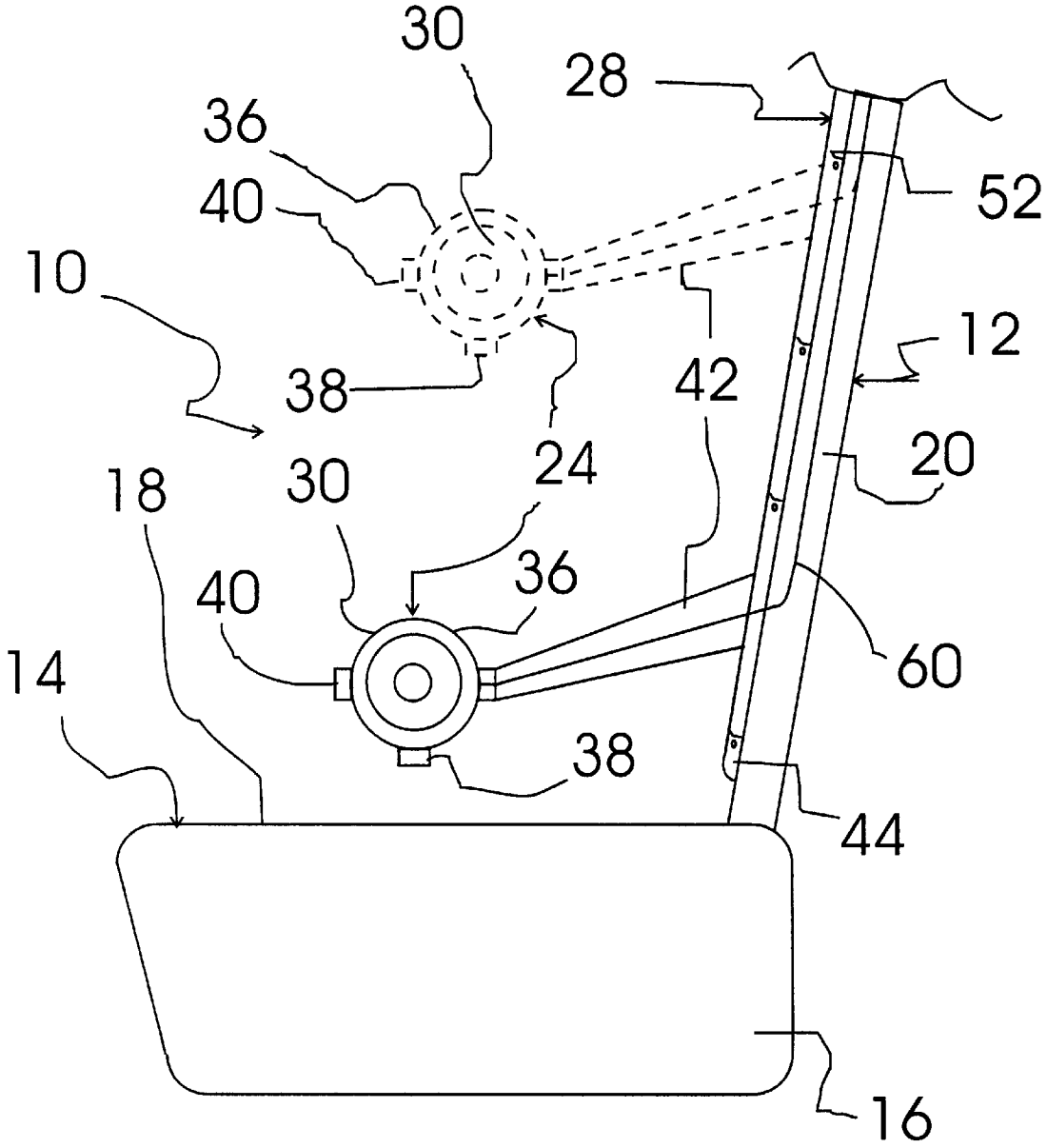
FIG. 2 is an enlarged front view of an area of FIG. 1, as indicated by arrow 2 in FIG. 1.
Figure 3:
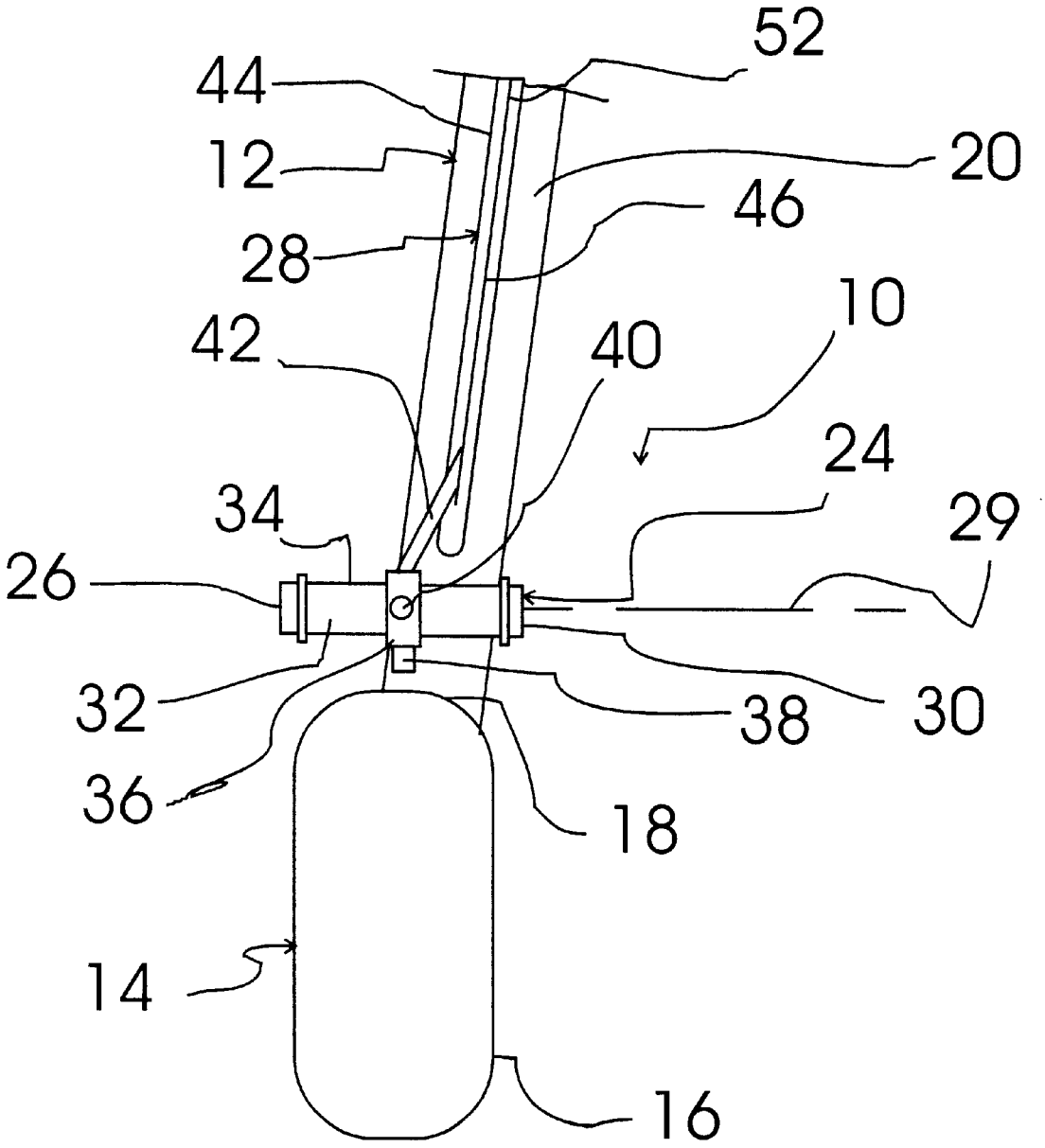
FIG. 3 is an enlarged side view taken in the direction of arrow 3 in FIG. 1 with the shaft broken away.
Figure 4:
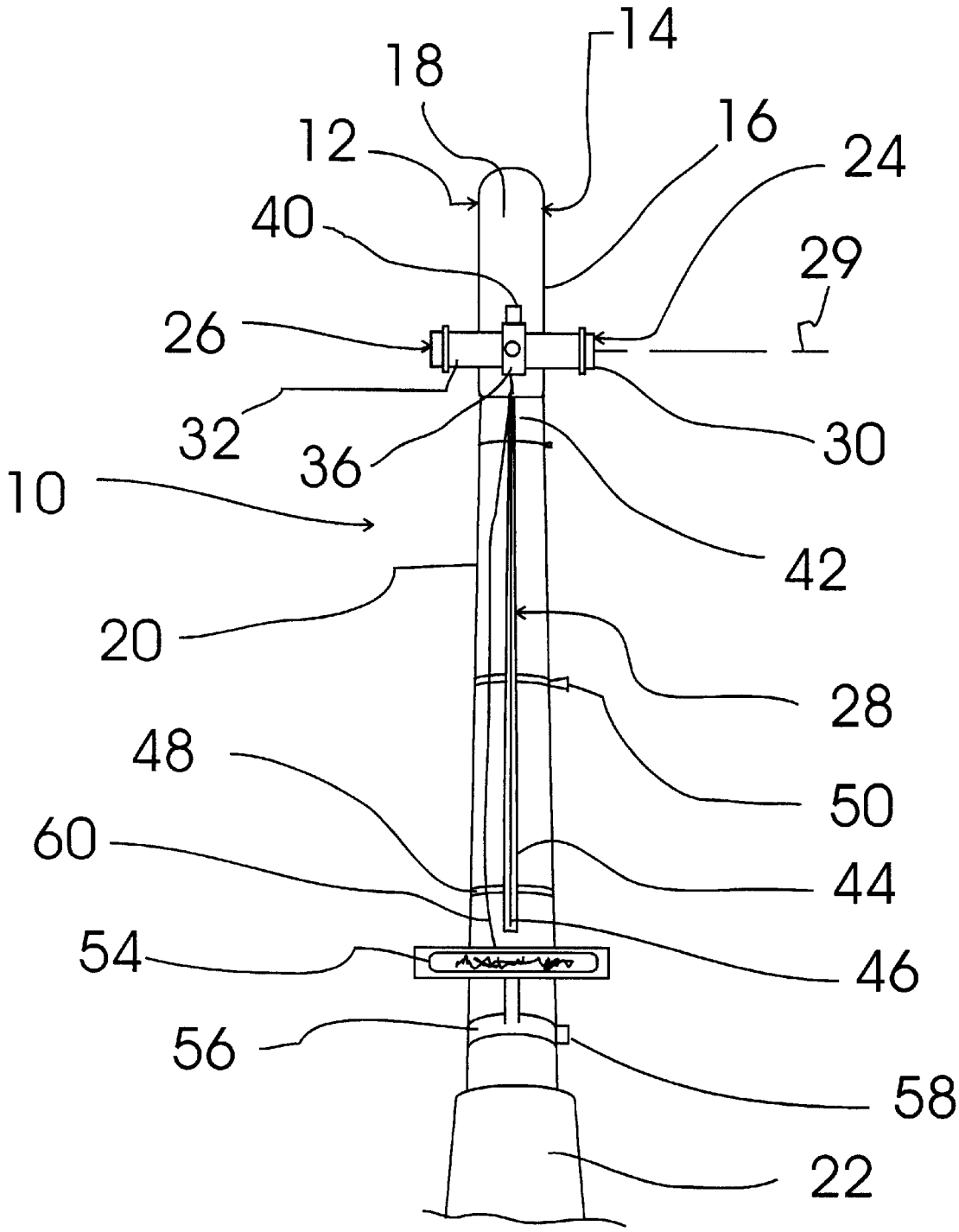
FIG. 4 is an enlarged top view taken in the direction of arrow 4 in FIG. 1, with the grip broken away.

Turning now descriptively to the drawings, in which similar reference characters denote similar elements throughout the several views, FIGS. 1 through 4 illustrate the various features of the present invention being a laser putter system 10 for a conventional putter golf club 12 of the type having a club head 14 with a golf ball striking face 16 and an upper surface 18, a shaft 20 connected to the upper surface 18 of the club head 14 and a grip 22 on the shaft 20. The laser putter system 10 comprises a laser pointer/range finder 24, 26. A mounting means 28 is for mounting laser pointer/range finder 24, 26 onto shaft 20 of conventional putter golf club 12 over upper surface 18 of club head 14. Laser pointer 24 can project a laser beam 29 away from golf ball striking face 16 of club head 14 to provide the golfer with a visible target being a hole to putt a golf ball into. Range finder 26 will interpret the distance between laser pointer 24 and the hole to visually give the golfer a calculated distance to the hole, so as to gauge the proper force required for a successful putt.

Laser pointer/range finder 24, 26 includes a laser device 30 for producing, the laser beam 29 being a very narrow, intense beam of coherent light and a range meter circuit 32 for measuring the distance to the hole. Laser pointer/range finder 24, 26 further contains a cylindrical casing 34 placed through a circular housing 36 for holding laser device 30 and range meter circuit 32 therein. An on/off switch with battery access 38 is attached to bottom side of circular housing 36 and a laser adjustment knob 40 is on a forward side of circular housing 36.

Mounting means 28 comprises an arm 42 attached to and extending from a rearward side of circular housing 36. A rail 44 with a longitudinal track 46 receives arm 42 in a sliding manner. A plurality of rail clamps 48 with thumbscrew adjustments 50 engage with shaft 20 of conventional putter golf club 12. The rail 44 includes along both edges, a series of hash marks 52 measured in quarter-inch and inch increments, so as to properly move arm 42 within track 46 to adjust the height of laser pointer/range finder 24, 26 for different terrains and distances.

A light emitting diode display 54 is provided. A clamp 56 with a thumbscrew adjustment 58 extends from light emitting diode display 54 to engage with shaft 20 just below grip 22 of conventional putter golf club 12. A cable 60 extending from light emitting diode display 54 is in engagement with rail clamps 48 and is electrically connected to range meter circuit 32 in laser pointer/range finder 24, 26. The golfer can look at light emitting diode display 54 to visually see the measurement to the hole.

It can be seen from the preceding description that in use, a golfer mounts the laser pointer/range finder 24, 26 of the laser putter system 10 to the shaft 20 above the club head 14 aligning it so that the laser beam 29 is aimed at a downward angle to the ground, allowing the golfer to aim at the hole to putt a golf ball into. Next, the golfer wraps the cable 60 connecting the light emitting diode display 54 around the shaft 20 of the putter golf club 12, secures the cable 60 using the rail clamps 48, then mounts the light emitting diode display 54 on the shaft 20 just below the grip 22 of the putter golf club 12. Once the laser putter system 10 has been secured to the putter golf club 12, the golfer will activate the laser pointer/range finder 24, 26 by switching the switch 38 to the on position, then aiming the projected laser beam 29 at the hole the golfer wishes to putt the golf ball into. Should the hole the golfer wishes to putt the golf ball into be on the opposite side of a rise, the golfer will raise the height of the laser pointer/range finger 24, 26 along the track 46 within the rail 44 then aim appropriately. When aimed, the projected laser beam 29 of the laser pointer 24 will provide the golfer with a visible target while the range finder 26 will interpret the distance between the laser pointer 24 and the hole, providing the golfer with the calculated distance on the light emitting diode display 54. Use of the laser putter system 10 would provide the golfer with a way of sighting a target putting hole, along with the ability to gauge the proper force required for a successful putt.

It is noted that the embodiment of the laser putter system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A laser putter system for a conventional putter golf club of the type having a club head with a golf ball striking face and an upper surface, a shaft connected to the upper surface of the club head and a grip on the shaft, said laser putter system comprising:

a laser range finder; and mounting means for mounting said laser range finder onto the shaft of the conventional putter golf club over the upper surface of the club head, so that said laser pointer can project a laser beam away from the golf ball striking face of the club head to provide the golfer with a visible target being a hole to putt a golf ball into, while said range finder will interpret the distance between said laser pointer and the hole to visually give the golfer a calculated distance to the hole, so as to gauge the proper force required for a successful putt;

said laser range finder including a laser device for producing the laser beam being a very narrow, intense beam of coherent light and a range meter circuit for measuring the distance to the hole;

said laser range finder further including a cylindrical casing placed through a circular housing for holding said laser device and said range meter circuit therein;

said mounting means including an arm attached to and extending from a rearward side of said circular housing, a rail with a longitudinal track to receive said arm in a sliding manner and a plurality of rail clamps with thumbscrew adjustments to engage with the shaft of the conventional putter golf club.

2. The laser putter system as recited in claim 1, wherein:

said rail includes along both edges a series of hash marks measured in quarter-inch and inch increments, so as to properly move said arm within said track to adjust the height of said laser range finder for different terrains and distances.

3. The laser putter system as recited in claim 1, further including:

a light emitting diode display, a clamp with a thumbscrew adjustment extending from said light emitting diode display to engage with the shaft just below the grip of the conventional putter golf club, and a cable extending from said light emitting diode display in engagement with said rail clamps and electrically connected to said range meter circuit in said laser range finder, so that the golfer can look at said light emitting diode display to visually see the measurement to the hole.

* * * * *